US010995907B2

(12) United States Patent
Baba

(10) Patent No.: US 10,995,907 B2
(45) Date of Patent: May 4, 2021

(54) HIGH-PRESSURE TANK

(71) Applicant: TOYOTA JIDOSHA KABUSHIKI KAISHA, Toyota (JP)

(72) Inventor: Yoichiro Baba, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 64 days.

(21) Appl. No.: 16/411,187

(22) Filed: May 14, 2019

(65) Prior Publication Data

US 2020/0032958 A1 Jan. 30, 2020

(30) Foreign Application Priority Data

Jul. 25, 2018 (JP) ..... JP2018-139424

(51) Int. Cl.
*F17C 1/02* (2006.01)
*F17C 13/06* (2006.01)

(52) U.S. Cl.
CPC ..... *F17C 1/02* (2013.01); *F17C 13/06* (2013.01); *F17C 2201/0109* (2013.01); *F17C 2203/012* (2013.01); *F17C 2203/0619* (2013.01); *F17C 2203/0663* (2013.01)

(58) Field of Classification Search
CPC ..... F17C 2203/012–00617; F17C 2203/0619; F17C 2203/0626; F17C 2203/0663; F17C 2205/03; F17C 2205/0308; F17C 1/02; F17C 1/06; F17C 2202/0109; F17C 2260/011; F16B 1/00; B65D 83/38
See application file for complete search history.

(56) References Cited

U.S. PATENT DOCUMENTS 6,227,402 B1 * 5/2001 Shimojima ..... F17C 1/16 220/581
10,158,130 B2 * 12/2018 Otsubo ..... B32B 27/34
2009/0152278 A1 * 6/2009 Lindner ..... H01M 8/04201 220/589
2010/0072209 A1 * 3/2010 Hatta ..... F17C 1/16 220/586

(Continued)

FOREIGN PATENT DOCUMENTS

JP 2008-164131 7/2008
JP 2015-017641 1/2015
JP 2016-176599 10/2016

*Primary Examiner* — J. Gregory Pickett
*Assistant Examiner* — Abigail Elizabeth Guidry
(74) *Attorney, Agent, or Firm* — Oblon, McClelland, Maier & Neustadt, L.L.P.

(57) ABSTRACT

A high-pressure tank includes: a cylindrical hollow container; an outer shell that is formed of a fiber-reinforced plastic band which is wound on an outer circumference of the hollow container to cover the outer circumference; and a cap that is attached to an inner side of at least one of one axial end and the other axial end of the outer shell. The hollow container is formed of a material which has airtightness and which is able to expand and contract in an axial direction and a radial direction inside the outer shell, and a frictional portion that is used to set a frictional resistance to an inner circumferential surface of the outer shell to be greater than that in the other area is provided in an axial intermediate portion on an outer circumferential surface of the hollow container.

3 Claims, 4 Drawing Sheets

(56) References Cited

U.S. PATENT DOCUMENTS

| | | | | |
|---|---|---|---|---|
| 2012/0024745 | A1* | 2/2012 | Otsuka | B29C 63/24 206/524.3 |
| 2015/0014332 | A1 | 1/2015 | Nishibu | |
| 2015/0338022 | A1* | 11/2015 | Tanabe | F17C 1/00 220/590 |
| 2019/0285227 | A1* | 9/2019 | Veenstra | F17C 1/02 |
| 2020/0276775 | A1* | 9/2020 | Ueda | B29C 70/323 |

* cited by examiner

HIGH-PRESSURE TANK

INCORPORATION BY REFERENCE

The disclosure of Japanese Patent Application No. 2018-139424 filed on Jul. 25, 2018 including the specification, drawings and abstract is incorporated herein by reference in its entirety.

BACKGROUND

1. Technical Field

The disclosure relates to a high-pressure tank with a double-shell structure in which an outer circumference of a cylindrical hollow container is covered with an outer shell formed of fiber-reinforced plastic.

2. Description of Related Art

For example, Japanese Unexamined Patent Application Publication No. 2008-164131 (JP 2008-164131 A) states that an outer circumference of a hollow container formed of a liner is covered with a reinforcing material layer formed of fiber-reinforced plastic and the hollow container and the reinforcing material layer are bonded to each other by an adhesive.

For example, Japanese Patent No. 5999039 (Japanese Unexamined Patent Application Publication No. 2015-017641 (JP 2015-017641 A)) states that an outer circumference of a liner having a cap attached to both ends thereof is covered with a reinforcement layer formed of fiber-reinforced plastic and a release agent layer is formed in the entire area between the liner and the reinforcement layer (see Paragraph 0019) and that a release agent layer may be formed in a partial area (a dome portion of the liner) between the liner and the reinforcement layer (see Paragraphs 0006 and 0031).

SUMMARY

In JP 2008-164131 A, since the hollow container and the reinforcing material layer are bonded to each other by the adhesive, a stress is normally applied to the liner.

On the other hand, when the release agent layer is formed in the entire area between the liner and the reinforcement layer as described in Paragraph 0019 of Japanese Patent No. 5999039 (JP 2015-017641 A), the liner expands and contracts freely inside the reinforcement layer due to change in the internal pressure thereof, which is superior to JP 2008-164131 A in terms of a decrease in stress. However, since an expansion/contract starting point of the liner relative to the reinforcement layer is not determined when the liner expands and contracts in an axial direction, concentration of a stress on an area (see F in FIG. 4 in Japanese Patent No. 5999039 (JP 2015-017641 A)) connecting a dome portion at one end in the axial direction of the liner to the cap cannot be said to be avoided.

Paragraphs 0006 and 0031 in Japanese Patent No. 5999039 (JP 2015-017641 A) states that "when the release agent layer is formed on the outer surface of the curved dome portion of the liner, concentration of a stress on a local area of the liner can be curbed, but a "position at which the release agent layer is not formed between the liner and the reinforcement layer" is not described in Japanese Patent No. 5999039 (JP 2015-017641 A). Accordingly, when the position at which the release agent layer is not formed is not suitable, there is concern that a stress may be concentrated on an area (see F in FIG. 4 in Japanese Patent No. 5999039 (JP 2015-017641 A)) connecting the dome portion at one end in the axial direction of the liner to the cap. There is room for improvement regarding this point.

The disclosure provides a high-pressure tank that can curb concentration of a stress on one end in an axial direction of a hollow container due to change in the internal pressure of the hollow container or the like.

According to an aspect of the disclosure, there is provided a high-pressure tank including: a cylindrical hollow container; an outer shell that is formed of a fiber-reinforced plastic band which is wound on an outer circumference of the hollow container to cover the outer circumference; and a cap that is attached to an inner side of at least one of a first axial end and a second axial end of the outer shell, wherein the hollow container is formed of a material which has airtightness and which is able to expand and contract in an axial direction and a radial direction inside the outer shell, and a frictional portion that is used to set a frictional resistance to an inner circumferential surface of the outer shell to be greater than that in other areas is provided in an axial intermediate portion on an outer circumferential surface of the hollow container.

According to this configuration, when the hollow container expands or contracts in the axial direction in the outer shell, for example, due to change in the internal pressure of the hollow container, the frictional portion of the hollow container is less deformed in the axial direction relative to the outer shell than the other areas and thus one axial end and the other axial end of the hollow container expand or contract equivalently in the axial direction with the frictional portion as a starting point.

Accordingly, it is possible to curb or prevent concentration of a stress on one (a local area) of one axial end and the other axial end of the hollow container.

The term, "frictional portion," is used to refer to a portion having a function of restricting an amount by which the axial intermediate portion on the outer circumferential surface of the hollow container is deformed in the axial direction relative to the inner circumferential surface of the outer shell and is also used to refer to a portion having a function of restricting deformation of the axial intermediate portion on the outer circumferential surface of the hollow container in the axial direction relative to the inner circumferential surface of the outer shell.

In addition, when deformation as described above is not intended, it is conceivable that the frictional resistance of the axial intermediate portion on the outer circumferential surface of the hollow container with respect to the inner circumferential surface of the outer shell be infinitely increased by bonding the axial intermediate portion on the outer circumferential surface of the hollow container to the inner circumferential surface of the outer shell.

In the high-pressure tank, a ventilation hole may be provided at least at one end in the axial direction of the hollow container, and a ventilation tube that is slidably fitted into the ventilation hole may be provided in the cap that is disposed on a side on which the ventilation hole is provided.

According to this configuration, a relationship between the hollow container and the cap is specified. According to this specification, when one axial end and the other axial end of the hollow container expands or contracts in the axial direction, it is clear that one axial end and the other axial end are deformed relative to the cap.

In the high-pressure tank, the frictional portion may be formed of a plurality of undulations that are scattered over an entire area of the outer circumferential surface of the hollow container in a circumferential direction.

According to this configuration, by winding the outer shell formed of the fiber-reinforced plastic band on the hollow container, the plurality of undulations serving as the frictional portion of the hollow container intrude into the inner circumferential surface of the outer shell.

Accordingly, since the frictional resistance of the frictional portion in the axial intermediate portion on the outer circumferential surface of the hollow container with respect to the inner circumferential surface of the outer shell increases as much as possible, deformation of the axial intermediate portion of the hollow container in the axial direction relative to the inner circumferential surface of the outer shell is limited.

In the high-pressure tank, the frictional portion may be formed of a large-diameter portion that is provided to protrude outward in the radial direction.

According to this configuration, by winding the outer shell formed of the fiber-reinforced plastic band on the hollow container, the large-diameter portion serving as the frictional portion of the hollow container strongly comes into press contact with the inner circumferential surface of the outer shell.

Accordingly, since the frictional resistance of the frictional portion in the axial intermediate portion on the outer circumferential surface of the hollow container with respect to the inner circumferential surface of the outer shell increases as much as possible, deformation of the axial intermediate portion of the hollow container in the axial direction relative to the inner circumferential surface of the outer shell is limited.

In the high-pressure tank, an area on the side of one axial end and an area on the side of the other axial end in the outer circumference of the hollow container with respect to the frictional portion may be formed in a conical shape such that outer diameters thereof decrease gradually toward an edge.

According to this configuration, for example, when an internal pressure increases due to filling the hollow container with a gas, the area on the side of one axial end and the area on the side of the other axial end in the hollow container are likely to expand in the axial direction.

According to the aspect of the disclosure, it is possible to provide a high-pressure tank that can curb concentration of a stress on one end in an axial direction of a hollow container due to change in the internal pressure of the hollow container or the like.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Hereinafter, exemplary embodiments of the disclosure will be described in detail with reference to the accompanying drawings.

Figure 1:
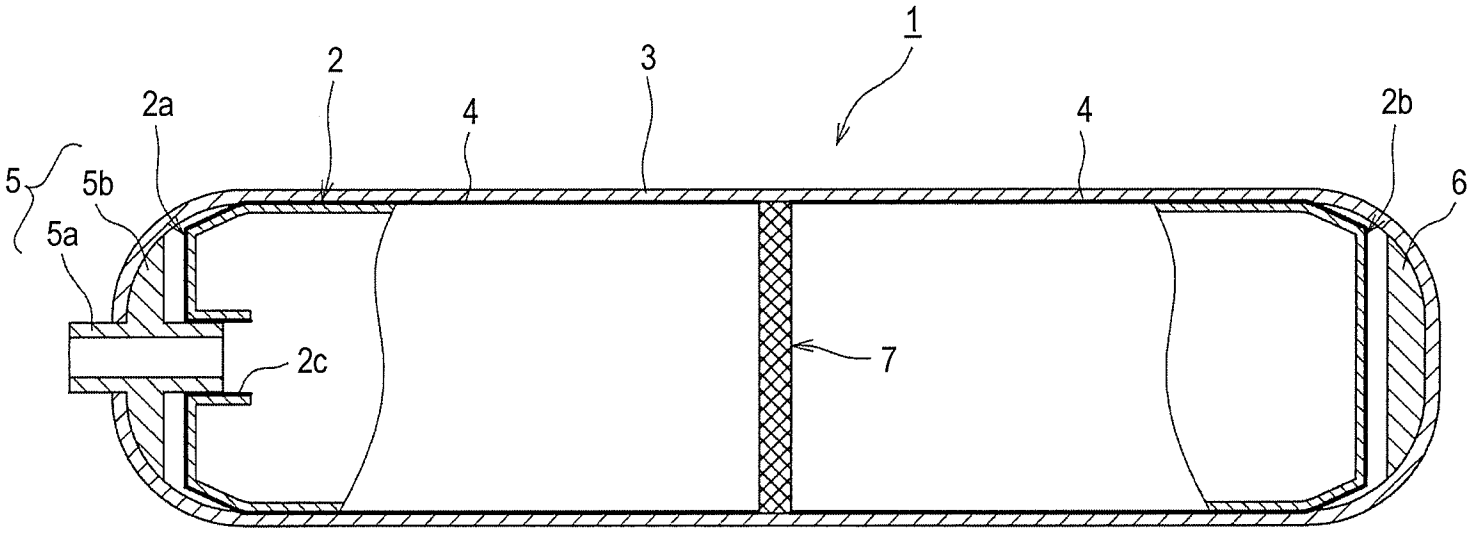
FIG. 1 is a side view illustrating a high-pressure tank according to an embodiment of the disclosure and illustrating a section of a portion other than an axial intermediate portion of a hollow container.

An embodiment of the disclosure is illustrated in FIG. 1. In FIG. 1, a high-pressure tank 1 is illustrated as a whole. The high-pressure tank 1 is used, for example, to store hydrogen or the like which is used for an onboard fuel cell system and has a double-shell structure in which an outer circumference of a hollow container 2 is covered with an outer shell 3.

The hollow container 2 is formed, for example, in a cylindrical shape of which the size in an axial direction is larger than an outer diameter thereof. A first dome portion 2*a* is provided at one end in the axial direction and a second dome portion 2*b* is provided at the other end in the axial direction.

The hollow container 2 is formed of a material which has excellent airtightness and which is relatively flexible and expands and contracts in the axial direction and a radial direction. The hollow container 2 can be formed of a polyimide resin such as nylon. A polyimide resin has excellent airtightness such as a gas barrier property with respect to the hydrogen and has a large thermal expansion coefficient.

A first ventilation hole 2*c* is provided at the center of the first dome portion 2*a* of the hollow container 2 to penetrate the hollow container 2 along the center axis thereof.

The first ventilation hole 2*c* is formed as an internal hole of a cylindrical portion which is provided to protrude inwardly from the first dome portion 2*a* of the hollow container 2.

Since the outer shell 3 has high strength to guarantee the strength of the high-pressure tank 1, the outer shell 3 can be formed of fiber-reinforced plastic in which a thermosetting resin is impregnated into a reinforcing fiber.

Specifically, the outer shell 3 can be formed by applying a release agent 4 onto the outer surface of the hollow container 2, curing the release agent 4 in a film shape, and winding the film around the hollow container 2 using a filament winding method (hereinafter also referred to as an FW method).

For example, an epoxy resin can be used as the thermosetting resin. For example, a carbon fiber can be used as the reinforcing fiber. For example, a fluorine-based release agent or a silicon-based release agent can be used as the release agent 4.

A first cap 5 is disposed inside one axial end of the outer shell 3, and a second cap 6 is disposed inside the other axial end of the outer shell 3.

A feed nozzle (not illustrated) that is used to fill the hollow container 2 with hydrogen and the like or a discharge nozzle (not illustrated) that is used to discharge hydrogen and the like in the hollow container 2 to the outside are attached to the first cap 5.

The first cap 5 has a configuration in which an annular plate portion 5*b* extending outward in a radial direction is integrally formed in an axial intermediate portion of a first ventilation tube 5*a*. The first ventilation tube 5*a* is formed of, for example, an aluminum alloy and is slidably fitted into the first ventilation hole 2*c* of the hollow container 2. The second cap 6 is formed of an annular plate.

The outer surfaces of the annular plate portion 5*b* of the first cap 5 and the second cap 6 formed of an annular plate are bonded to the inner surfaces of one axial end and the other axial end of the outer shell 3, but the inner surface of the annular plate portion 5*b* of the first cap 5 is not bonded to the outer surface of the first dome portion 2*a* of the hollow container 2, and the inner surface of the second cap 6 formed of an annular plate is not bonded to the outer surface of the second dome portion 2*b* of the hollow container 2 and can be separated therefrom.

In this embodiment, a frictional portion 7 is provided in an axial intermediate portion on the outer circumferential surface of the hollow container 2.

The frictional portion 7 is provided to fix the position of the axial intermediate portion of the outer circumferential surface of the hollow container 2 such that the axial intermediate portion is not deformed in the axial direction relative to the outer shell 3 by setting the frictional resistance of the axial intermediate portion on the outer circumferential surface of the hollow container 2 with respect to the inner circumferential surface of the outer shell 3 to be greater than that of the other area.

Specifically, the frictional portion 7 in this embodiment includes a plurality of undulations. Specifically, the plurality of undulations serving as the frictional portion 7 are scattered in a dot matrix shape continuously over the entire area of the axial intermediate portion on the outer circumferential surface of the hollow container 2 in the circumferential direction.

Only the frictional portion 7 on the outer circumferential surface of the hollow container 2 is bonded to the thermosetting resin constituting the outer shell 3, and the area other than the frictional portion 7 on the outer circumferential surface of the hollow container 2 is not bonded to the thermosetting resin constituting the outer shell 3. A method for providing such a configuration will be described below.

A process sequence of manufacturing the high-pressure tank 1 will be described below.

First, a hollow container 2 having a frictional portion 7 formed thereon is prepared. Specifically, the hollow container 2 is manufactured by injection molding, and an undulation group corresponding to the frictional portion 7 is provided in a mold which is used for the injection molding, and thus the undulation group is transferred to a predetermined position on the hollow container 2 having been subjected to the injection molding to form the frictional portion 7.

By applying a release agent 4 to the entire outer surface of the hollow container 2 which has been manufactured in this way, for example, using a spray or a brush and drying the release agent 4 using hot air or the like, the release agent 4 is formed in a film shape on the outer surface of the hollow container 2.

The first cap 5 and the second cap 6 are temporarily fastened to both ends in the axial direction of the hollow container 2. Specifically, an inner protruding portion of the first cap 5 into the first ventilation tube 5*a* is fitted into the first ventilation hole 2*c* of the hollow container 2. In this state, since the release agent 4 is interposed between the outer surfaces of the first dome portion 2*a* and the second dome portion 2*b* of the hollow container 2 and the inner surfaces of the first cap 5 and the second cap 6 and between the first ventilation hole 2*c* of the hollow container 2 and the inner protruding portion of the first cap 5 into the first ventilation tube 5*a*, the hollow container 2 and the first cap 5 are relatively deformable, the hollow container 2 and the second cap 6 are relatively deformable, and the inner protruding portion of the first cap 5 into the first ventilation tube 5*a* is slidable in the first ventilation hole 2*c* of the hollow container 2.

Subsequently, after the inner pressure is increased to expand the hollow container 2 and to increase the strength thereof by filling the hollow container 2 with an appropriate amount of gas (for example, nitrogen or air), the first ventilation tube 5*a* of the first cap 5 is closed.

Then, an outer shell 3 is formed by winding a fiber-reinforced plastic band in which a thermosetting resin is impregnated into a reinforcing fiber around the outer circumferences of the hollow container 2, the first cap 5 and the second cap 6 using an FW method and thermally curing the thermosetting resin.

A hoop winding pattern, a helical winding pattern with a low angle or a high angle, or the like can be used as the band winding pattern. By thermally curing the thermosetting resin, the thermosetting resin is bonded to the outer surfaces of the annular plate portion 5*b* of the first cap 5 and the second cap 6 formed of an annular plate, but the thermosetting resin is not bonded to the outer circumferential surface of the hollow container 2 because the release agent 4 is formed on the outer circumferential surface of the hollow container 2.

Here, since the release agent 4 attached to protrusions of the frictional portion 7 including a group of a plurality of undulations provided in the axial intermediate portion of the hollow container 2 is removed due to a pressure when the fiber-reinforced plastic band is wound, the undulation group serving as the frictional portion 7 of the hollow container 2 is bonded to the inner circumferential surface of the outer shell 3 in an intruded state. Accordingly, the frictional resistance of the frictional portion 7 of the hollow container 2 with respect to the outer shell 3 increases as much as possible.

Thereafter, the gas filled in the hollow container 2 is taken out by cooling the hollow container 2. Accordingly, since the thermal expansion coefficient of the hollow container 2 is greater than the thermal expansion coefficient of the outer shell 3, the hollow container 2 contracts more than the outer shell 3, a gap is formed between the area other than the frictional portion 7 on the outer circumferential surface of the hollow container 2 and the inner circumferential surface of the outer shell 3, a gap is formed between the outer surfaces of the first dome portion 2*a* and the inner surface of the annular plate portion 5*b* of the first cap 5, and a gap is formed between the second dome portion 2*b* and the inner surface of the second cap 6 formed of an annular plate.

When the high-pressure tank 1 manufactured in this way is filled with hydrogen or the like, the hollow container 2 elastically expands in the radial direction and the axial direction, but the axial intermediate portion of the hollow container 2 is positioned relative to the inner circumferential surface of the outer shell 3 such that it is not deformable in the axial direction because the frictional portion 7 including the undulation group is bonded to the outer shell 3.

Accordingly, when the hollow container 2 expands in the axial direction, one axial end and the other axial end of the hollow container 2 expand with the frictional portion 7 in the axial intermediate portion of the hollow container 2 as a starting point and thus an amount of expansion of the hollow container 2 toward one axial end becomes equal to an amount of expansion of the hollow container 2 toward the other axial end.

As a result, it is possible to curb or prevent concentration of a stress on one (a local area) of one axial end and the other axial end of the hollow container 2.

In this embodiment, since the frictional portion 7 including an undulation group is provided continuously over the entire area of the axial intermediate portion on the outer circumferential surface of the hollow container 2 in the circumferential direction, it is possible to prevent a load from being locally input.

The disclosure is not limited to the above-mentioned embodiment and can be appropriately modified within the scope of the appended claims and within a range equivalent to the scope.

Figure 2:
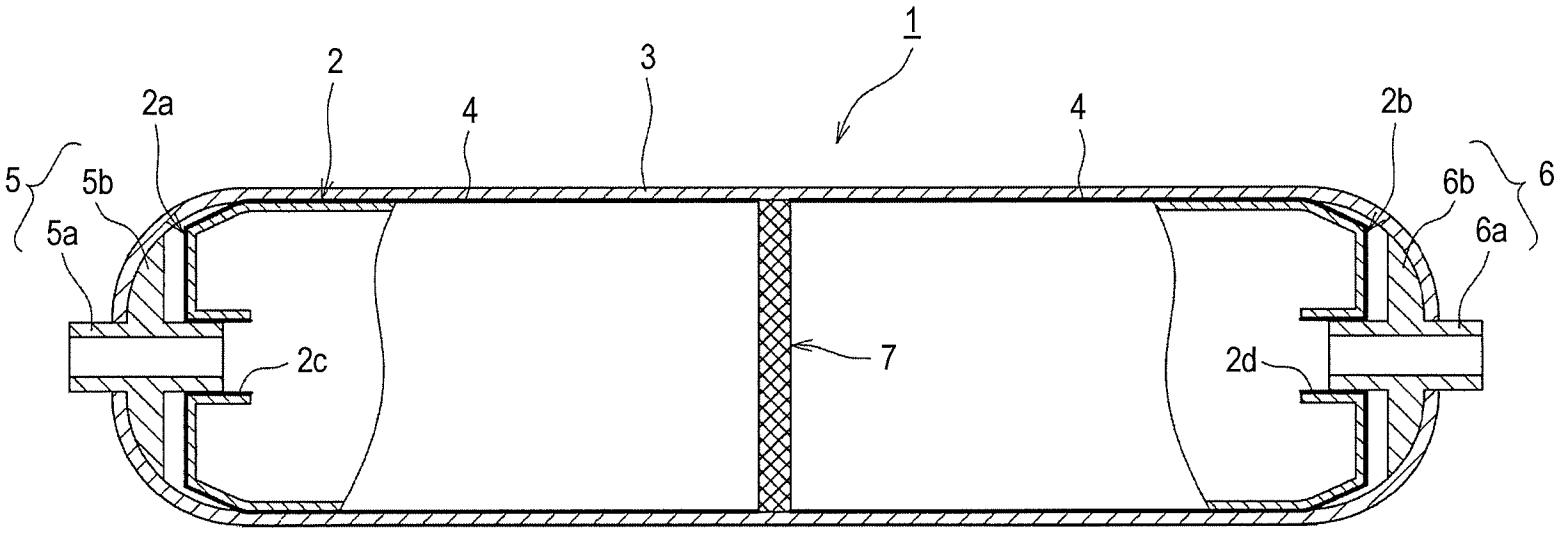
FIG. 2 is a side view illustrating a high-pressure tank according to another embodiment of the disclosure and illustrating a section of a portion other than an axial intermediate portion of a hollow container.

(1) For example, another embodiment of the disclosure is illustrated in FIG. 2. This embodiment is a modified example of the embodiment illustrated in FIG. 1. In this embodiment, a first ventilation hole 2*c* is provided at the center of the first dome portion 2*a* of the hollow container 2 to penetrate the hollow container 2 along the center axis thereof, and a second ventilation hole 2*d* is provided at the center of the second dome portion 2*b* of the hollow container 2 to penetrate the hollow container 2 along the center line thereof.

Similarly to the first cap 5, the second cap 6 has a configuration in which an annular plate portion 6*b* extending outward in the radial direction is integrally formed in the axial intermediate portion of a ventilation tube 6*a*. The ventilation tube 6*a* of the second cap 6 is slidably inserted into the second ventilation hole 2*d* of the second dome portion 2*b*.

The configuration is otherwise basically the same as in the embodiment illustrated in FIG. 1. In this embodiment, the same operations and advantages as in the above-mentioned embodiment are obtained.

(2) In the above-mentioned embodiments, the frictional portion 7 including the undulation group is provided continuously over the entire area of the axial intermediate portion on the outer circumferential surface of the hollow container 2 in the circumferential direction, but the disclosure is not limited thereto.

For example, the frictional portion 7 including the undulation group may be provided partially at predetermined intervals in the axial intermediate portion on the outer circumferential surface of the hollow container 2 in the circumferential direction, and this configuration is included in the disclosure. When the intervals are set to an equal interval, it is advantageous for preventing a load from being locally input.

Figure 3:
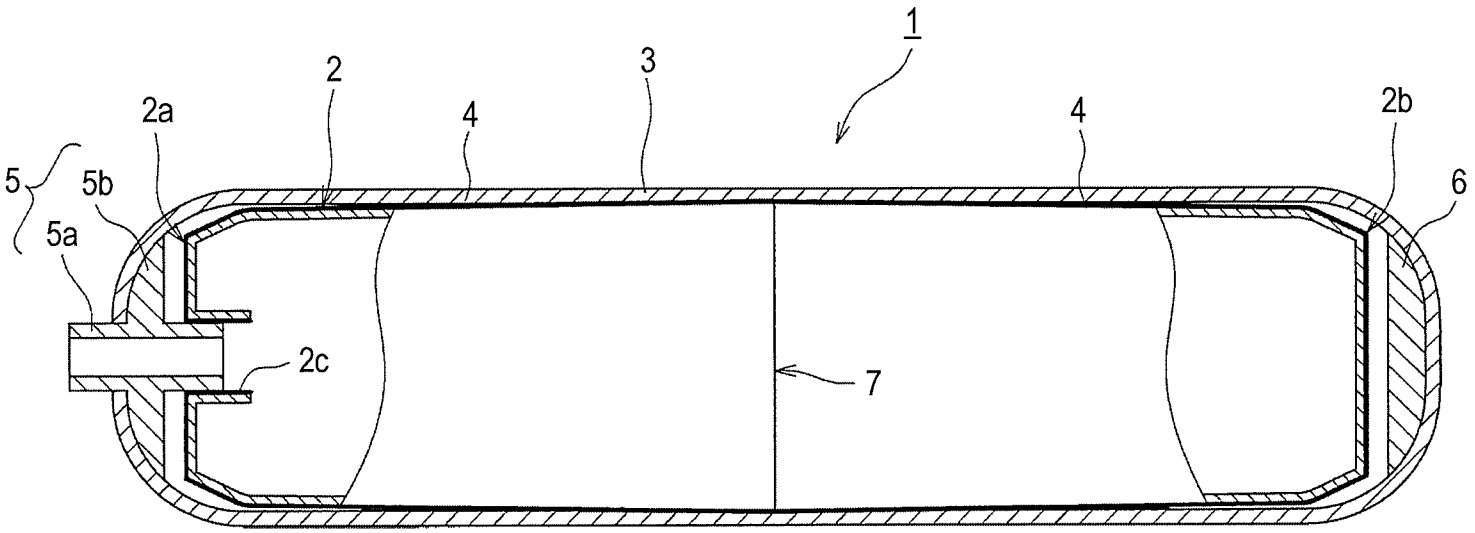
FIG. 3 is a side view illustrating a high-pressure tank according to still another embodiment of the disclosure and illustrating a section of a portion other than an axial intermediate portion of a hollow container.

(3) For example, another embodiment of the disclosure is illustrated in FIG. 3. This embodiment is a modified example of the embodiment illustrated in FIG. 1. In this embodiment, the frictional portion 7 is formed of a large-diameter portion that protrudes outward in the radial direction.

Specifically, the large-diameter portion serving as the frictional portion 7 is a portion having an outer-diameter larger than the outer diameters of an area on the side of one axial end and an area on the side of the other axial end on the outer circumferential surface of the hollow container 2, and is provided in the axial intermediate portion, particularly, at the center in the axial direction, of the hollow container 2.

The area on the side of one axial end from the frictional portion 7 to the first dome portion 2*a* and the area on the side of the other axial end from the frictional portion 7 to the second dome portion 2*b* are formed in a conical shape such that the outer diameter decreases gradually from the frictional portion 7 to the first dome portion 2*a* and the second dome portion 2*b*.

Accordingly, since a contact pressure of the frictional portion 7 of the hollow container 2 with the inner circumferential surface of the outer shell 3 is greater than a contact pressure of the area on the side of one axial end and the area on the side of the other axial end of the hollow container 2 with the inner circumferential surface of the outer shell 3, the frictional resistance of the frictional portion 7 of the hollow container 2 with respect to the inner circumferential surface of the outer shell 3 is greater than the frictional resistance of the area on the side of one axial end and the area on the side of the other axial end of the hollow container 2 with respect to the inner circumferential surface of the outer shell 3.

The method of manufacturing the high-pressure tank 1 according to this embodiment is the same as in the above-mentioned embodiment.

In this manufacturing method, in the process of winding the fiber-reinforced plastic band on the outer circumference of the hollow container 2, the large-diameter portion serving as the frictional portion 7 which is provided in the axial intermediate portion of the hollow container 2 is strongly pressed against the inner circumferential surface of the outer shell 3 by the pressure of winding. Accordingly, even when the release agent 4 is formed in the frictional portion 7, the frictional resistance of the frictional portion 7 with respect to the inner circumferential surface of the outer shell 3 is greater than the frictional resistance of the area other than the frictional portion 7 with respect to the inner circumferential surface of the outer shell 3.

In the process of taking out the gas filled in the hollow container 2 by cooling the hollow container 2, since the thermal expansion coefficient of the hollow container 2 is greater than the thermal expansion coefficient of the outer shell 3, the hollow container 2 contracts more than the outer shell 3 and a gap is formed each of between the area (the conical portion) other than the frictional portion 7 on the outer circumferential surface of the hollow container 2 and the outer shell 3, between the first dome portion 2*a* and the first cap 5 and between the second dome portion 2*b* and the second cap 6.

From this regard, when the high-pressure tank 1 manufactured using the above-mentioned manufacturing method is filled with hydrogen or the like, the hollow container 2 elastically expands in the radial direction and the axial direction, but since the large-diameter portion serving as the frictional portion 7 is strongly pressed against the inner circumferential surface of the outer shell 3 at that time, the axial intermediate portion of the hollow container 2 is not deformed in the axial direction relative to the inner circumferential surface of the outer shell 3.

Accordingly, when the hollow container 2 expands in the axial direction, one axial end and the other axial end of the hollow container 2 expand with the frictional portion 7 in the axial intermediate portion of the hollow container 2 as a starting point and thus an amount of expansion of the hollow container 2 toward one axial end becomes equal to an amount of expansion of the hollow container 2 toward the other axial end.

As a result, it is possible to curb or prevent concentration of a stress on one (a local area) of one axial end and the other axial end of the hollow container 2.

Particularly, when the area on the side of one axial end and the area on the side of the other axial end on the outer circumferential surface of the hollow container 2 are formed in a conical shape as in this embodiment, the area on the side of one axial end and the area on the side of the other axial end of the hollow container 2 are likely to expand in the axial direction when the internal pressure increases due to filling of the hollow container 2 with a gas.

On the other hand, in this embodiment, the area on the side of one axial end and the area on the side of the other axial end of the hollow container 2 with respect to the frictional portion 7 are not formed in a conical shape, but can be formed as a cylindrical small-diameter portion having an outer diameter less than that of the large-diameter portion serving as the frictional portion 7 or the frictional portion 7 may be formed with a large width in the axial direction.

Figure 4:
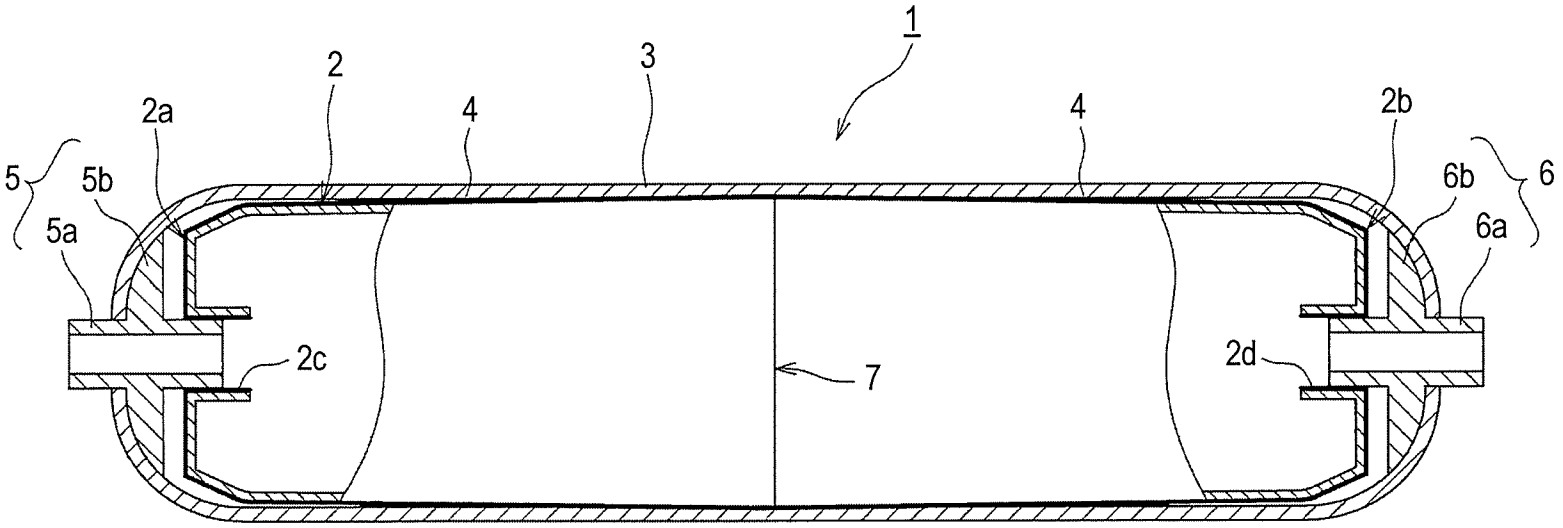
FIG. 4 is a side view illustrating a high-pressure tank according to still another embodiment of the disclosure and illustrating a section of a portion other than an axial intermediate portion of a hollow container.

(4) For example, another embodiment is illustrated in FIG. 4. This embodiment is a modified example of the embodiment illustrated in FIG. 3. In this embodiment, the first ventilation hole 2*c* is provided at the center of the first dome portion 2*a* of the hollow container 2 to penetrate the hollow container 2 along the center axis thereof and the second ventilation hole 2*d* is provided at the center of the second dome portion 2*b* of the hollow container 2 to penetrate the hollow container 2 along the center axis thereof.

Similarly to the first cap 5, the second cap 6 has a configuration in which an annular plate portion 6*b* extending outward in the radial direction is integrally formed with the axial intermediate portion of the ventilation tube 6*a*. The ventilation tube 6*a* of the second cap 6 is slidably inserted into the second ventilation hole 2*d* of the second dome portion 2*b*.

The other configurations are basically the same as those in the embodiment illustrated in FIG. 3. According to this embodiment, the same operations and advantages as in the above-mentioned embodiments are obtained.

(5) In the above-mentioned embodiments, the frictional portion 7 which is provided in the axial intermediate portion on the outer circumferential surface of the hollow container 2 is formed as a group of a plurality of undulations or a large-diameter portion, but the disclosure is not limited thereto.

For example, although not illustrated, the release agent 4 may not be formed in the axial intermediate portion on the outer circumferential surface of the hollow container 2 but a thermosetting resin of fiber-reinforced plastic which serves as the outer shell 3 may be bonded to the portion in which the release agent 4 is not formed.

In this case, the frictional resistance of the portion (referred to as a release agent non-formed portion) in which the release agent 4 is not formed in the axial intermediate portion and which is bonded with respect to the outer shell 3 is remarkably greater than that in the area on the side of one axial end and the area on the side of the other axial end in which the release agent 4 is formed on the outer circumferential surface of the hollow container 2. From this regard, the release agent non-formed portion in the axial intermediate portion on the outer circumferential surface of the hollow container 2 corresponds to an example of the frictional portion of the disclosure.

Specifically, in the process of forming the release agent 4 on the outer circumferential surface of the hollow container 2, the axial intermediate portion on the outer circumferential surface of the hollow container 2 is masked in a band shape which has a predetermined width in the axial direction and which is continuous in the circumferential surface, the release agent 4 is applied to the entire outer circumferential surface of the hollow container 2, and then a band-shaped release agent non-formed portion is formed in the axial intermediate portion on the outer circumferential surface of the hollow container 2 by removing the mask.

According to this configuration, in the process of winding a fiber-reinforced plastic band on the outer circumferential surface of the hollow container 2 to form the outer shell 3, the thermosetting resin of fiber-reinforced plastic constituting the outer shell 3 is bonded to the release agent non-formed portion serving as the frictional portion 7 in the axial intermediate portion on the outer circumferential surface of the hollow container 2.

According to this embodiment, the same operations and advantages as in the above-mentioned embodiments are obtained.

(6) In the above-mentioned embodiments, the length in the axial direction of the hollow container 2 is larger than the outer diameter thereof, but the disclosure is not limited thereto. For example, the outer diameter of the hollow container 2 may be set to be equal to or larger than the length in the axial direction. This example is also included in the disclosure.

What is claimed is:

1. A high-pressure tank comprising:

a cylindrical hollow container;

an outer shell that is formed of a fiber-reinforced plastic band which is wound on an outer circumference of the hollow container to cover the outer circumference; and a cap that is attached to an inner side of at least of one a first axial end and a second axial end of the outer shell, wherein the hollow container is formed of a material which has airtightness and which is able to expand and contract in an axial direction and a radial direction inside the outer shell, and a frictional portion is provided in an axial intermediate portion on an outer circumferential surface of the hollow container, the frictional portion having a frictional resistance to an inner circumferential surface of the outer shell that is greater than that in portions other than the frictional portion on the outer circumferential surface of the hollow container, wherein the frictional portion is provided to fix a position of the axial intermediate portion of the outer circumferential surface of the hollow container such that the axial intermediate portion is not deformed in the axial direction relative to the outer shell, and wherein the frictional portion includes a plurality of undulations that are scattered in a dot matrix shape continuously over an entire area of the axial intermediate portion on the outer circumferential surface of the hollow container in a circumferential direction.

2. The high-pressure tank according to claim 1, wherein a ventilation hole is provided at least at one end in the axial direction of the hollow container, and a ventilation tube that is slidably fitted into the ventilation hole is provided in the cap that is disposed on a side on which the ventilation hole is provided.

3. The high-pressure tank according to claim 1, wherein the frictional portion is provided in the area consisting of the axial intermediate portion on the outer circumferential surface of the hollow container.

* * * * *